US006190505B1

(12) United States Patent
Kayser

(10) Patent No.: US 6,190,505 B1
(45) Date of Patent: Feb. 20, 2001

(54) APPARATUS AND METHOD FOR MOISTENING A MATERIAL WEB

(75) Inventor: Franz Kayser, Geldern (DE)

(73) Assignee: Voith Sulzer Papiertechnik Patant GmbH, Heidenheim (DE)

( * ) Notice: Under 35 U.S.C. 154(b), the term of this patent shall be extended for 0 days.

(21) Appl. No.: 09/322,173

(22) Filed: May 28, 1999

(30) Foreign Application Priority Data

May 29, 1998 (DE) ..... 198 24 170

(51) Int. Cl.[7] ..... D21G 7/00

(52) U.S. Cl. ..... 162/204; 162/206; 162/199; 162/193; 162/289; 162/290; 162/DIG. 6

(58) Field of Search ..... 162/202, 199, 162/204, 206, 207, 193, 289–290, 252, 263, 119, 121, DIG. 6; 427/284, 285; 34/115, 114–120, 611, 545, 79, 635, 455, 443, 451, 445, 60–62; 239/421, 545; 118/316, 325

(56) References Cited

U.S. PATENT DOCUMENTS 3,948,721 * 4/1976 Winheim ..... 162/119
4,249,992 * 2/1981 Wells ..... 162/198
4,836,894 * 6/1989 Chance et al. ..... 162/253
4,915,788 * 4/1990 Winheim ..... 162/207
5,221,346 * 6/1993 Anderson ..... 118/405
5,355,595 * 10/1994 Koivukunnas et al. ..... 34/570
5,384,968 * 1/1995 Grandjean ..... 37/79
5,469,636 * 11/1995 Plomer ..... 34/117
5,557,860 * 9/1996 Kotitschke et al. ..... 34/455
5,778,559 * 7/1998 Winheim ..... 34/611
5,914,008 * 6/1999 Winheim ..... 162/206

FOREIGN PATENT DOCUMENTS 3741680 6/1989 (DE) .
0609544 8/1994 (EP) .

* cited by examiner

*Primary Examiner*—Stanley S. Silverman
*Assistant Examiner*—José A. Fortuna
(74) *Attorney, Agent, or Firm*—Greenblum & Bernstein, P.L.C.

(57) ABSTRACT

An apparatus for moistening a material web, the material web having opposed edges and a marginal region at each edge, the apparatus including a moistening device adapted to cover the marginal regions of the material web, so that only the marginal regions are moistened. Also provided is a method for moistening a material web, the method including covering the marginal regions of the material web with a moistening apparatus, and moistening only the marginal regions of the material web covered by the moistening apparatus.

24 Claims, 1 Drawing Sheet

APPARATUS AND METHOD FOR MOISTENING A MATERIAL WEB

CROSS-REFERENCE TO RELATED APPLICATIONS

The present application claims priority under 35 U.S.C. § 119 of German Patent Application No. 198 24 170.4, filed on May 29, 1998, the disclosure of which is expressly incorporated by reference herein in its entirety.

BACKGROUND OF THE INVENTION

1. Field of the Invention

The invention relates to an apparatus and method for moistening a material web, and more particularly, to an apparatus for moistening a paper or cardboard web.

2. Discussion of Background Information

In paper making machines, problems frequently arise at the marginal regions (i.e., the edge regions) of a paper web. Such problems can arise in the headbox, where the fibers in these marginal regions are arranged in both the longitudinal direction (as in the center of the web), and in the width direction. The web tends to dry out more severely at the margins (i.e., the edges) of the web. At the surface of a drying cylinder, the region adjacent the web is hotter, because less heat dissipates from this region. Consequently, the edges of the web dry out more rapidly. This drying is also exacerbated by the fact that the marginal regions of the web are closest to the dry atmosphere of the paper-making facility and thus also give off moisture by convection.

Attempts to counteract this drying have been made by designing relatively complicated dryer cylinders, which apply heat to the edge regions of the web. Overheating at the edge regions of the web, however, leads to shrinkage and embrittlement in these marginal regions, which is disadvantageous for subsequent satinizing processes (i.e., the production of smoothness and/or gloss). Shrinkages lead to increases of density and thickness of the web edges.

Also, attempts to counteract these increases in density and thickness by applying less material at the headbox have led to undesirable results. Moreover, installation of a system of this kind is not possible for older facilities. The embrittlement no longer permits any reasonable smoothing in the calender, because the compressibility of the web is greatly restricted. The difference in alignment of the fibers at the web exacerbates this problem.

In German Patent Application No. DE 37 41 680, a related art moistening device is described, which extends over the full width of the web, with different transverse moisture profiles being selectable through a plurality of setting members.

SUMMARY OF THE INVENTION

The present invention provides an apparatus and method for moistening a material web. The apparatus of the invention includes a moistening device adapted to cover the marginal regions of the material web, so that only the marginal regions are moistened. The moistening device may additionally cover the upper and lower surfaces of the web, and may be further adapted to moisten the marginal regions of the material web on both upper and lower surfaces of the material web.

According to a feature of the invention, the moistening device may include at least two moisteners disposed in operative relation to a respective edge of the material web.

Further, at least one of the moisteners may have a generally "U"-shaped cross section. The moistener may also be adapted to engage about a marginal region of the material web and cover the upper and lower surfaces of a marginal region of the material web. Also, the marginal region covered may be between approximately 10 cm and 15 cm, in a width direction of the web. Additionally, the size of the covered regions on the upper and lower surfaces are approximately equal to one another.

According to another feature of the invention, the moistener may have a generally U-shaped cross section, with the two arms of the moistening device being pivotable relative to one another, so that the moistener is adjustable between an open position and a closed position.

The moistening device may be a vapor moistener which may or may not be heated. If a heated vapor moistener is used, the heated vapor moistener may have a double sleeve. A condensation discharge outlet and/or a suction device may also be provided. Further, an elongated moistener extending the direction of web travel may also be used. The length of the elongated moistener may be such that the web dwells within the moistener for at least approximately 0.3 ms, at a predetermined running speed. Additionally, the elongated moistener may be a vapor moistener.

The method of the present invention includes covering the marginal regions of the material web with a moistening apparatus, and moistening only the marginal regions of the material web covered by the moistening apparatus. The method may further include covering, with the moistening apparatus, the upper and lower surfaces of the web, and moistening the marginal regions of the material web on both upper and lower surfaces of the material web. Further, both marginal regions of the web may be moistened.

According to a certain feature of the invention, the moistening apparatus may have a generally "U"-shaped cross section, the method may further include engaging the moistening apparatus about a marginal region of the material web, and covering the upper and lower surfaces of a marginal region of the material web.

According to a feature of the invention, the method may further include pivoting the two arms of the "U"-shaped moistening apparatus relative to one another, between an open position and a closed position. The pivoting "U"-shaped moistening apparatus may further be a vapor moistener which may or may not be heated, and may or may not have a double sleeve.

The present invention provides a moistening device which moistens and conditions a material web, e.g., a paper or cardboard web, so that the web margins can be easily satinized.

The moistening apparatus only covers the edge regions of the material web so that only moistening of these marginal regions takes place.

The moistening apparatus of the invention can be used in conjunction with a calender or the like. Smoothness and an ideal gloss is achievable through the invention, especially for the edges of the material web. Thus, an undesired drop in the moisture content, and an undesired increase in thickness at the edge is counteracted in a simple and reliable manner.

In a certain feature of the moistening apparatus of the invention, the marginal regions of the material web are each covered by the apparatus on upper and lower web surfaces, so that in these marginal regions, two-sided moistening (i.e., upper and lower surface moistening) of the material web takes place.

The moistening apparatus may also include at least two moisteners, each associated with a respective marginal region of the material web.

It is also advantageous if at least one moistener has a generally "U"-shaped cross section ("U" shaped meaning: having two generally parallel arms connected at one end by a member extending between the parallel arms), thereby enabling the moistener to engage about the marginal web region and thus cover both surfaces. The moistener covers approximately 10 to 15 cm of the web in the width direction of the web. When using a U-shaped moistener, the covered regions of the two surfaces of the web are approximately the same size.

In a certain feature of the moistening apparatus of the invention, at least one moistener having a U-shaped cross-section is provided, with the two arms of the "U" portion of the moistener being pivotable relative to one another, so that the moistener is adjustable between an open position and a closed operating position, the open position serving for the draw-in of the web.

At least one moistener of a plurality of moisteners may be provided as a vapor moistener, thereby enabling simultaneous heating of the respective material web.

It is also advantageous if at least one heated vapor moistener of a plurality of moisteners is provided, preferably with a double sleeve (i.e. the sleeve having both an inner wall and an outer wall). The intermediate space between the walls of the sleeve forms a vapor blowing chamber. This chamber can be fed with hot steam, so that the walls of the vapor chamber are heated, thereby counteracting condensation and the resulting undesired droplet formation. The steam may then substantially first condense on the material web.

It is also advantageous if at least one vapor moistener is provided with a condensation discharge outlet. Additionally, at least one vapor moistener of a plurality of moisteners is also provided with a suction device for excess steam.

At least one elongate moistener extending in a web travel direction is preferably provided. The length of the elongate moistener is such that at a predetermined web running speed, a dwell time of the web in the moistener of at least 0.3 ms results.

Other exemplary embodiments and advantages of the present invention may be ascertained by reviewing the present disclosure and the accompanying drawings.

BRIEF DESCRIPTION OF THE DRAWINGS

The present invention is further described in the detailed description which follows, in reference to the noted plurality of drawings by way of non-limiting examples of certain embodiments of the present invention, in which like numerals represent like elements throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
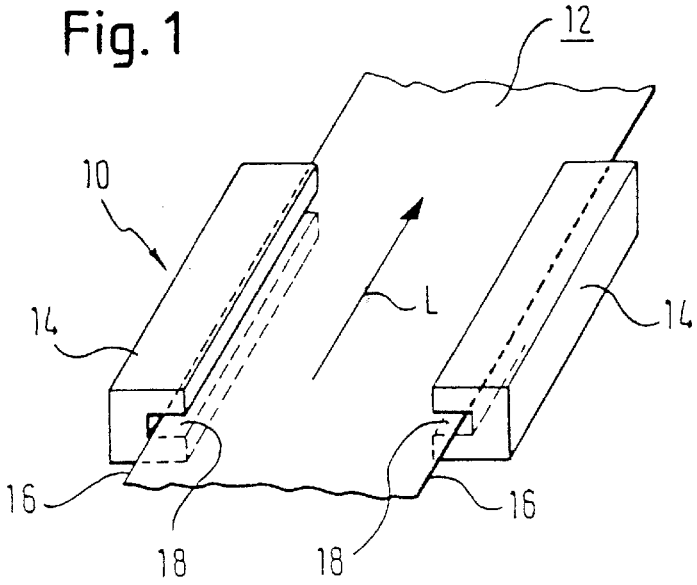
FIG. 1 is a perspective schematic representation of a first embodiment of an apparatus for the moistening of a material web.

Referring to the drawings wherein like numerals represent like elements, FIG. 1 shows in a schematic illustration a first embodiment of an apparatus 10 for the moistening of a material web 12 such as a paper or cardboard web.

As shown in FIG. 1, the material web 12 is guided in a web travel direction "L" by the moistening apparatus 10, with only the marginal regions (i.e., the edge regions) of the web being covered over by the apparatus 10, so that only the marginal regions are moistened. Each marginal region of the material web 12 is covered on both surfaces, so that two-sided moistening of the material web 12 takes place.

The moistening apparatus 10 includes two vapor moisteners 14 each oppositely disposed in operative relation to a respective edge region (i.e., a respective marginal region) of the material web 12. In other words, each moistener 14 covers a respective edge region of the material web 12. The vapor moisteners 14 each have a generally U-shaped cross-section, which surrounds a respective marginal region and covers both the upper and lower surfaces of the web.

The covered regions on the two edges 16 of the web are approximately the same size. They may have a width ranging from about 10 cm to about 15 cm measured in the direction of the web width.

The vapor moisteners 14 are preferably heated and are each provided with a double sleeve. The intermediate space in each vapor moistener 14 contains a vapor blowing chamber 18 which can be fed with hot steam. After the vapor blowing chamber 18 has been heated, condensation and thus undesired droplet formation in the vapor blowing chamber 18 is prevented. Thus, it is ensured that the vapor first condensates on the material web 12, thereby resulting in ideal heat transfer.

Figure 2:
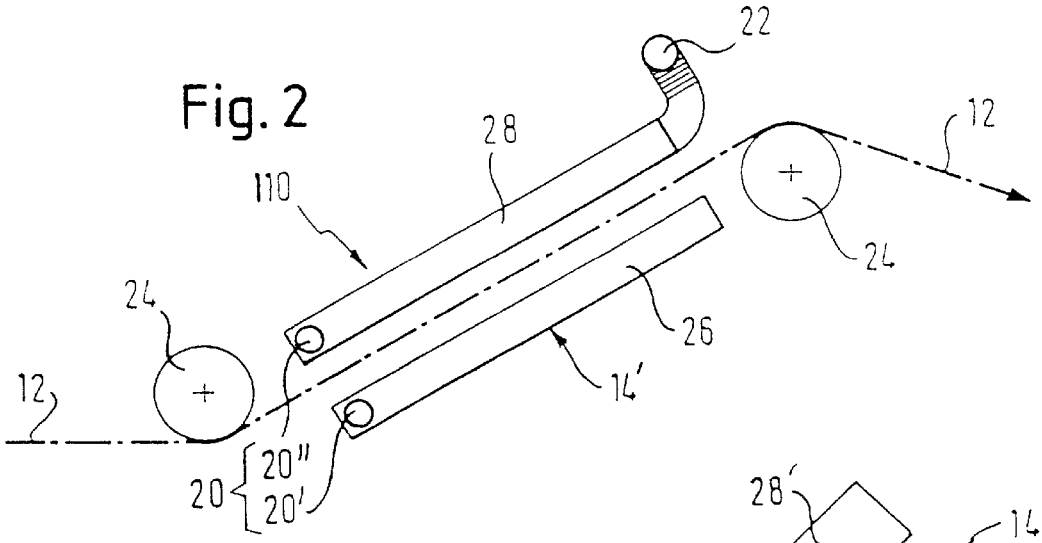
FIG. 2 is a side schematic representation of a second embodiment of a moistening apparatus provided with a condensation discharge outlet and a suction device for excess steam.

FIG. 2 shows a schematic representation of a vapor moistener 14' of a second embodiment of the moistening apparatus 110. The apparatus 110 is provided with a condensation discharge outlet 20 and a suction device 22 for excess steam.

The moistening apparatus 110 moistens the material web 12 in a region in which the material web 12 is obliquely guided upward between two deflection rolls 24. The two vapor moisteners 14' of the moistening apparatus 110 (of which only one can be seen in FIG. 2) are also inclined. The moistening apparatus 110 has an upper arm 28 and a lower arm 26. As shown in FIG. 2, a respective discharge line 20', 20" for condensation from the condensation discharge outlet 20 is provided in a respective lower region of each of the two arms 26, 28 of the vapor moistener 14'. Also as shown in FIG. 2, the suction device 22 for excess steam is provided in the upper region of the upper arm 28 of the vapor moistener 14'.

Figure 3:
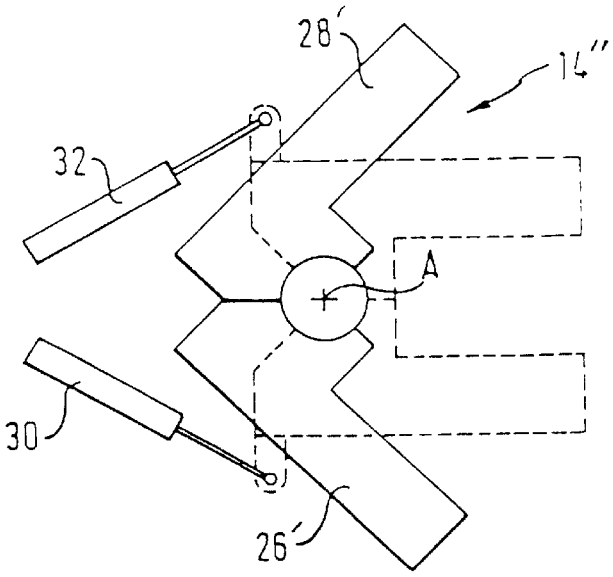
FIG. 3 is a schematic illustration of an outwardly pivotable vapor moistener.

FIG. 3 shows a schematic illustration of an alternate embodiment of an outwardly pivotable vapor moistener 14". The pivotable vapor moistener 14" has a U-shaped cross-section and two arms 26, 28 that are pivotable relative to one another about an axis A. The vapor moistener 14" is adjustable between an open position (shown in solid lines), which serves for the drawing in of the web, and a closed operating position (shown in broken lines). Additionally, at least one piston-in-cylinder unit 30, 32 acts on a respective arm 26', 28'.

As shown in the Figures, the moistening apparatus 10, 110 may be formed by two elongated vapor moisteners 14, 14', 14" extending in the web travel direction "L." These vapor moisteners 14, 14', 14" each have a length such that a dwell time of the web in the vapor moistener of at least 0.3 ms results at a predetermined web travel speed.

It is noted that the foregoing examples have been provided merely for the purpose of explanation and are in no way to be construed as limiting of the present invention. While the present invention has been described with reference to certain embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. An apparatus for moistening a material web, the material web having opposed edges and a marginal region at each edge, the apparatus comprising a moistening device adapted to cover and moisten the marginal regions of the material web, said moistening device comprising at least two moisteners disposed in operative relation to a respective edge of the material web, wherein at least one of said at least two moisteners has a generally "U"-shaped cross section, the at least one of said at least two moisteners adapted to engage about the marginal region of the material web and to cover the upper and lower surfaces of the marginal region of the material web.

2. The apparatus for moistening a material web according to claim 1, wherein the marginal region covered is between approximately 10 cm and 15 cm, in a width direction of the web.

3. The apparatus for moistening a material web according to claim 1, wherein the size of the covered marginal regions on the upper surface and the size of the covered regions on the lower surface are approximately equal.

4. The apparatus for moistening a material web according to claim 1, wherein the two arms of the "U"-shaped moistening device being pivotable relative to one another, so that the moistener is adjustable between an open position and a closed position.

5. The apparatus for moistening a material web according to claim 1, wherein said moistening device is a vapor moistener.

6. The apparatus for moistening a material web according to claim 1, wherein said moistening device is a heatable vapor moistener.

7. The apparatus for moistening a material web according to claim 6, wherein said heatable vapor moistener has a double sleeve.

8. The apparatus for moistening a material web according to claim 1, wherein said moistening device is a vapor moistener having a condensation discharge outlet.

9. The apparatus for moistening a material web according to claim 1, wherein said moistening device is a vapor moistener having a suction device.

10. The apparatus for moistening a material web according to claim 1, wherein said moistening device is an elongated moistener extending in a web travel direction.

11. The apparatus for moistening a material web according to claim 10, wherein the length of said elongated moistener is such that the web dwells within said moistener for at least approximately 0.3 ms at a predetermined running speed.

12. The apparatus for moistening a material web according to claim 11, wherein said elongated moistener is a vapor moistener.

13. A method for moistening a material web, the material web having opposed edges and a marginal region at each edge, the method comprising:

covering both marginal regions of the material web with a moistening apparatus having a generally "U"-shaped cross section, wherein each of the marginal regions is between about 10 and 15 cm in a width-wise direction;

engaging the moistening apparatus about a marginal region of the material web;

covering the upper and lower surfaces of a marginal region of the material web; and moistening only the marginal regions of the material web covered by the moistening apparatus.

14. The method for moistening a material web according to claim 1, wherein the size of the covered marginal regions on the upper surface and the size of the covered marginal regions on the lower surface are approximately equal.

15. The method for moistening a material web according to claim 13, further comprising:

pivoting two arms of the "U"-shaped moistening apparatus relative to one another, between an open position and a closed position.

16. The method for moistening a material web according to claim 13, wherein the moistening apparatus is a vapor moistener.

17. The method for moistening a material web according to claim 16, wherein the vapor moistener has a vapor blowing chamber therein, the method further comprising feeding the vapor blowing chamber with hot steam.

18. The method for moistening a material web according to claim 13, wherein the moistening apparatus is a heatable vapor moistener.

19. The method for moistening a material web according to claim 18, wherein the heatable vapor moistener has a double sleeve.

20. The method for moistening a material web according to claim 13, wherein the moistening apparatus is a vapor moistener having a condensation discharge outlet.

21. The method for moistening a material web according to claim 13, wherein the moistening apparatus is a vapor moistener having a suction apparatus.

22. The method for moistening a material web according to claim 13, wherein the moistening apparatus is an elongated moistener extending in a web travel direction.

23. The method for moistening a material web according to claim 22, wherein the length of the elongated moistener is such that the web dwells within the moistener for at least approximately 0.3 ms, at a predetermined running speed.

24. The method for moistening a material web according to claim 23, wherein the elongated moistener is a vapor moistener.

* * * * *